US007500803B2

(12) United States Patent
Gillard et al.

(10) Patent No.: US 7,500,803 B2
(45) Date of Patent: Mar. 10, 2009

(54) GROUND WORKING DEVICE FOR LIQUID TREATED ROADS

(75) Inventors: Ray W. Gillard, Edmonton (CA); Garett T. Schmidt, Leduc (CA)

(73) Assignee: Road Badger Inc., Edmonton (CA)

( * ) Notice: Subject to any disclaimer, the term of this patent is extended or adjusted under 35 U.S.C. 154(b) by 8 days.

(21) Appl. No.: 11/670,929

(22) Filed: Feb. 2, 2007

(65) Prior Publication Data

US 2008/0152427 A1 Jun. 26, 2008

(51) Int. Cl.
*E01C 23/00* (2006.01)

(52) U.S. Cl. ..... 404/83; 404/90; 404/92; 404/94

(58) Field of Classification Search ..... 404/90, 404/75, 93, 94; 299/39.1–41.1, 36.1; 37/242, 37/244, 386, 465
See application file for complete search history.

(56) References Cited

U.S. PATENT DOCUMENTS

| | | | | | |
|---|---|---|---|---|---|
| 2,042,837 | A * | 6/1936 | Gardner | 404/75 |
| 2,371,549 | A * | 3/1945 | Sembler et al. | 37/301 |
| 2,394,017 | A * | 2/1946 | Seaman | 404/95 |
| 2,424,459 | A * | 7/1947 | Hettelsater | 404/90 |
| 2,482,910 | A * | 9/1949 | Hettelsater | 404/90 |
| 2,755,092 | A * | 7/1956 | Donahoe | 239/651 |
| 3,224,347 | A * | 12/1965 | Seaman | 404/90 |
| 3,504,598 | A * | 4/1970 | Haker | 404/90 |
| 3,702,638 | A * | 11/1972 | Takata | 172/540 |
| 4,326,592 | A * | 4/1982 | Stephenson | 172/123 |
| 4,458,763 | A * | 7/1984 | Rao et al. | 172/32 |
| 4,473,320 | A * | 9/1984 | Register | 404/91 |
| 4,720,207 | A * | 1/1988 | Salani | 404/90 |
| 4,958,955 | A * | 9/1990 | Laditka | 404/75 |
| 5,562,365 | A * | 10/1996 | Berrange | 405/271 |
| 6,283,224 | B1 * | 9/2001 | Culver et al. | 172/685 |
| 6,368,014 | B1 * | 4/2002 | Culver et al. | 404/90 |
| 6,865,827 | B2 * | 3/2005 | Smith et al. | 37/386 |
| 2004/0172859 | A1 * | 9/2004 | Sakai et al. | 37/242 |
| 2006/0218823 | A1 * | 10/2006 | Olmr et al. | 37/244 |

FOREIGN PATENT DOCUMENTS

| | | |
|---|---|---|
| DE | 3043175 A1 | 10/1982 |
| GB | 1313744 A | 4/1973 |

* cited by examiner

*Primary Examiner*—Raymond W Addie
(74) *Attorney, Agent, or Firm*—Christensen O'Connor Johnson Kindness PLLC

(57) ABSTRACT

A ground working device for liquid treated roads is formed from a mobile main frame, a sub-frame, plural discs mounted for rotation on the sub-frame about an axis that extends transversely under the sub-frame; and a set of tines mounted on each disc in ground contacting position. The tines efficiently lift the ground surface material while reducing the amount to which the liquid treated ground mixture clumps on the tines. Each tine in each set of tines has a perpendicular base that extends perpendicularly to the disc on which the respective tine is mounted. The sub-frame is retractably mounted on the main frame.

16 Claims, 9 Drawing Sheets

PRIOR ART

GROUND WORKING DEVICE FOR LIQUID TREATED ROADS

BACKGROUND

A road resurfacing unit is disclosed in U.S. Pat. No. 5,795,096 issued Aug. 18, 1998, which uses teeth to rip a gravel road prior to separating coarse material from fine material and depositing the coarse material on the fine material. It is desirable to have efficient separation of coarse and fine material. The design in U.S. Pat. No. 5,795,096 uses discs commonly used in farm implements. A ground working device is disclosed by the same inventors in Canadian Patent No. 2,293,885. While these work satisfactorily, there is room for improvement. On some oiled or treated surfaces, an oil-gravel mix or liquid-gravel can ball up on the scoops of a ground working device, thus reducing efficacy of the device. There is a need for a ground working device that can lift and mix a liquid and gravel surface, re-work the road surface and deposit it back on the road with the gravel mixed in with the liquid. This patent proposes a solution for the need for improved mixing and granulation while reducing the amount that a liquid-gravel mix becomes balled up on the scoops of a ground working device.

SUMMARY

Therefore, in an embodiment there is provided a ground working apparatus for roads. The ground working device has a mobile main frame, a sub-frame and plural discs mounted for rotation on the sub-frame about an axis that extends transversely under the mobile main frame. A set of tines with a flow through and lifting surface is mounted on each disc. A ripper bar extends transversely under the mobile main frame.

In an embodiment there is provided a ground working apparatus for roads, particularly liquid treated roads, comprising a sub-frame retractably mounted under a mobile main frame. Plural tines with a flow through and lifting surface are mounted for rotation on the sub-frame to dig into and lift ground material as the mobile main frame advances over the ground. Plural scoops with concave ground contacting surfaces may also be mounted for rotation on the sub-frame to dig into and lift ground material as the mobile main frame advances over the ground.

In an embodiment there is provided a method of working on a road, particularly a liquid treated road, the method comprising the steps of: advancing a frame over the road, dragging a ripper bar across the road to rip up the road surface, and mixing and granulating the road surface by applying to the road surface plural tines, each with a flow through and lifting surface that, for example, moves in a direction opposed to the direction of movement of the frame over the ground.

These and other aspects of the device are set out in the claims, which are incorporated here by reference.

BRIEF DESCRIPTION OF THE FIGURES

Embodiments will now be described with reference to the figures, in which like reference characters denote like elements, by way of example, and in which.

DETAILED DESCRIPTION

In the claims, the word "comprising" is used in its inclusive sense and does not exclude other elements being present. The indefinite article "a" before a claim feature does not exclude more than one of the feature being present.

Figure 1:
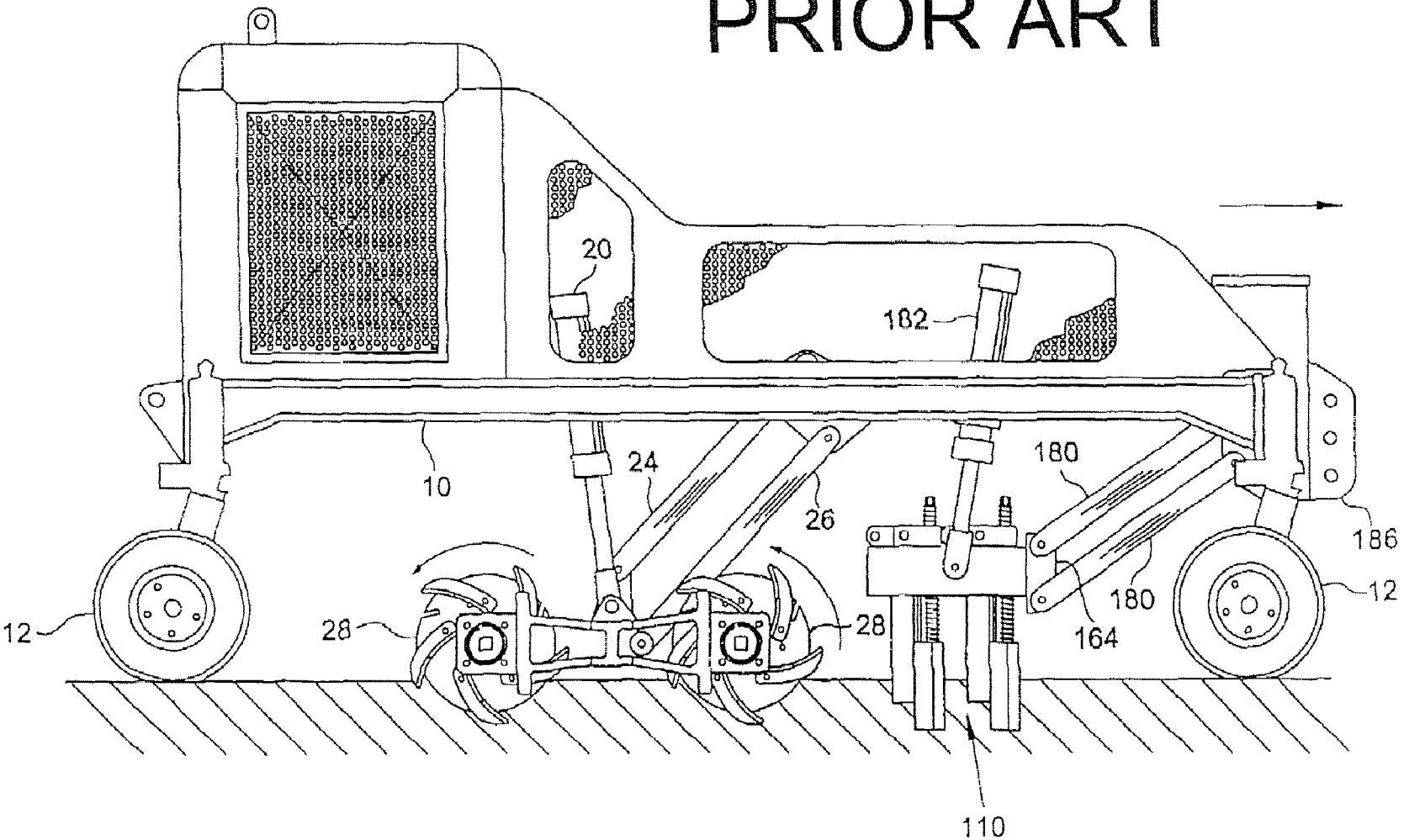
FIG. 1 is a side view of a ground working with a ground working device in fully extended position.

Referring to FIG. 1, the ground working apparatus of Canadian Patent No. 2,293,885 is shown. A mobile main frame 10 is supported by ground engaging wheels 12. A sub-frame is attached under the frame 10 with hydraulic arms 20 and swing arms 24 and 26. The hydraulic arms 20 raise and lower the sub-frame from a travel position to a maximum working position as shown in FIG. 1, and may fix the sub-frame at ground contacting positions between the travel position and maximum working position. The swing arms 24, 26 hold the sub-frame in a level position in relation to the ground, with each set of discs 28 on the sub-frame at equal height. A retractable tooth assembly 110 may be attached to the mobile main frame. Mounting bars 164 are used to secure a frame holding the retractable tooth assembly to swinging arms 180. The frame holding the retractable tooth assembly is raised and lowered using hydraulic arms 182 attached to either side of the frame 10.

Embodiments of a novel ground working apparatus are shown in FIGS. 2 to 7 in which one or both sets of scoops of the device shown in FIG. 1 is replaced by ground working tines 188. The ground working apparatus uses tines 188 to work the ground. The tines 188 allow material to flow across and pass beyond the tines 188. The discs disclosed for use with tines in FIGS. 2 to 6 may be smaller than those discs for use with scoops of the Canadian Patent No. 2,293,885. Smaller discs allow the tines 188 to work on the ground without the discs themselves going into the ground. Any of various designs may be used for the discs, a disc being an object that can be secured on a rod, shaft or axle, with circumferentially spaced locations to which the tines may be secured. Also, a ripper bar, for example a retractable tooth assembly, may be attached to the front of the ground working apparatus as in Canadian Patent No. 2,293,885. The discs having tines 188 may be placed behind the retractably tooth assembly 110 so that the tines may churn up the ground after it is ripped up by the retractable tooth assembly. The apparatus shown in FIGS. 2-7 has particular applicability to roads treated with liquids, such as petroleum products, lignin, oils of various types such as tall oil and vegetable oils and synthetic polymers.

Figure 2:
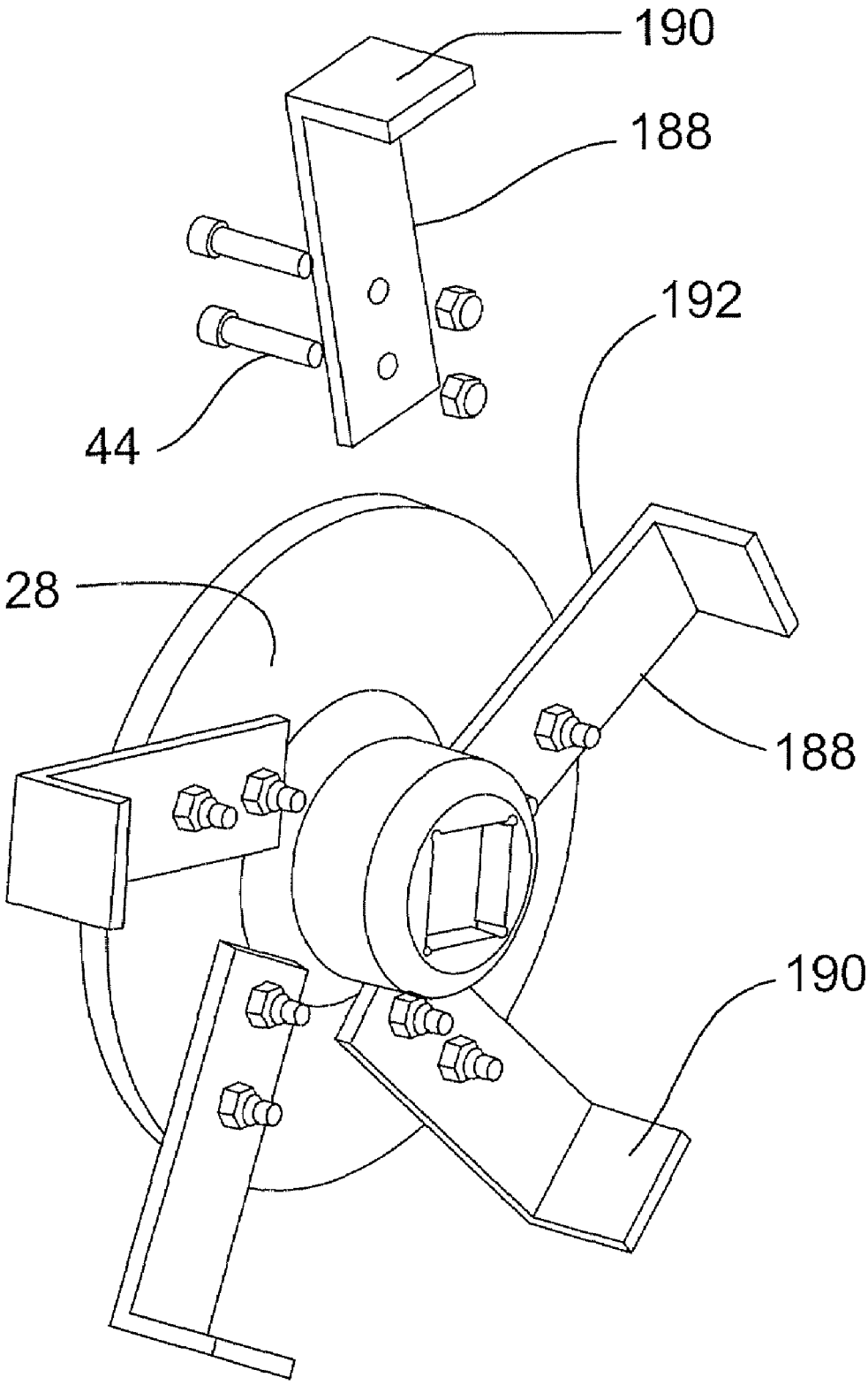
FIG. 2 is a side view of a disc with single tines.
Figure 5:
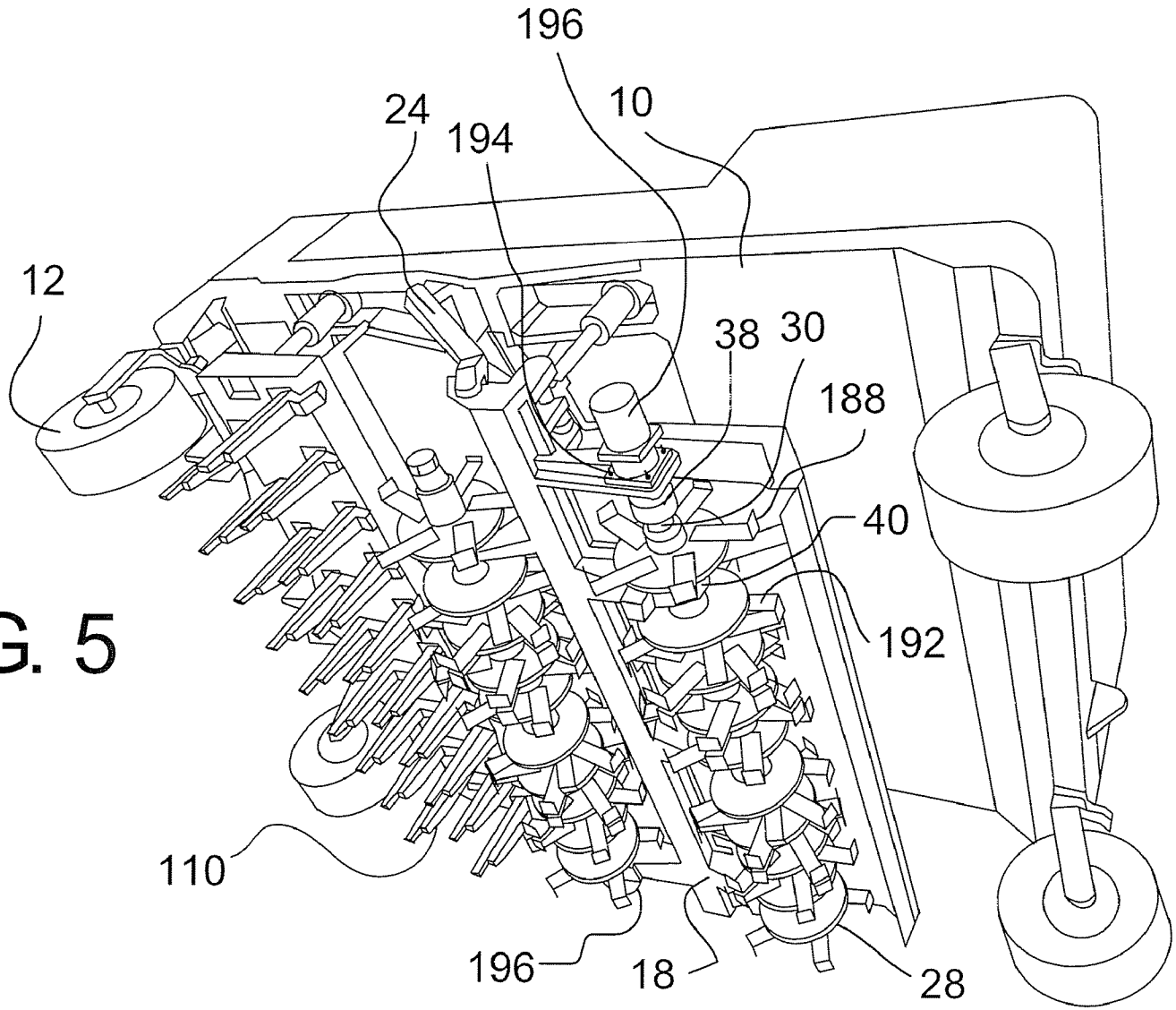
FIG. 5 is a perspective view of a ground working device with two sets of tines.

An embodiment of a disc 28 with tines 188 is shown in FIG. 2. Each tine 188 comprises a leg 192 and a ground working base 190. Each tine 188 is secured to the disc 28 with bolts 44. The tines 188 may be secured to the discs 28 by suitable means other than bolts. For example, the tines may be permanently welded to the discs. In the embodiment shown in FIG. 2, five tines 188 are secured to each disc 28. Other numbers of tines 188 on each disc 28 are possible. Also, the number of tines 188 on each disc 28 of a ground working device may differ from disc to disc. The discs 28 can be secured to a rod 30 (FIG. 5) with nuts 38 (FIG. 5), and interspaced along the rod 30 are bearings 40 (FIG. 5). In an embodiment the ground working base 190 of the tines have a flow through and lifting surface that allows material, such as a road surface comprising a mix of liquid and gravel, to flow across and pass beyond the tines 188 while reducing the amount to which the liquid-gravel mix becomes balled up.

In an embodiment, the tines 188 comprise a leg 192 and a ground working base 190 with a working surface that extends in a plane perpendicularly to the plane defined by the disc 28 on which the respective tine 188 is mounted. Other angles of the ground working base 190 with respect to the plane defined by the disc 28 are possible. The ground working base 190 is shaped and oriented to allow material to flow across and pass beyond the tines 188. The tines 188 have been found to function well when the tines 188 have a ground working base 190 that when the tine is extended to its fullest extent towards the ground, the angle of attack of the ground working base 190 (the angle that the working surface makes to the plane of the ground surface measured in the direction of travel of the ground working device) is non-zero, for example approximately nine degrees. That is, each tine 188 has been found to function well when each leg 192 is off parallel, for example at nine degrees, to a radius of the disc 28 on which the respective tine 188 is mounted. However, other angles of the ground working base 190 of the tine are also possible provided that the ground working base 190 allows material to flow across and pass beyond the tine 188 without becoming balled up. Thus, angles down to zero degrees may be acceptable, and the upper limit being determined by the viscosity of the material being worked. In addition, in an embodiment, the length of the ground working base 190 is restricted to allow typical liquid-gravel mixes on a road surface to flow over the base 190 in use. When a ground working base 190 is too short, the mixing function is reduced. On the other hand, greater mixing may be obtained by greater lengths, but if the length of the ground working base 190 is too long, material will no longer flow over the ground working base 190. Lengths of 1 cm to 10 cm may be acceptable, depending on the application. The ground working base 190 may thus be longer or shorter than shown in FIG. 2, both in a circumferential direction and transversely to the disc (along the disc axis) as long as the tines 188 do not interfere with one another. The forward edge of the tines 188 provides a surface that tends to fragment, mix and granulate the road surface as the tines advanced across the ground. The sloped orientation of the working surface of the tines 188 provides enhanced lifting of the ground surface as the tines 188 move upward during rotation.

The tines 188 may be attached to the discs 28 so that a line from the center of the disc to the outer circumference of the disc coincides with the axis of symmetry of each tine. Thus, to allow the ground working base 190 of such a tine 188 to work on the ground without causing material to ball up on it, the working surface of the ground working base 190 may be constructed at an angle to the leg 192 of the tine so that the rearward edge of the ground working base 190 is closer to the center of the disc 28 than the forward edge of the ground working base 190. Other configurations may be possible that allow the ground working base 190 to re-work a mixture of ground and liquid, while reducing the amount to which the mixture will ball up on the ground working base 190. For example, the ground working base 190 need not have a flat working surface. The working surface for example may be convex, concave, corrugated or uneven. Also, the ground working base 190 may have two or more bars extending outward, for example perpendicularly, from the legs 192 of the tine rather than one single flat bar with a flat working surface. The ground working base 190 may also have the shape of a wedge.

Figure 3:
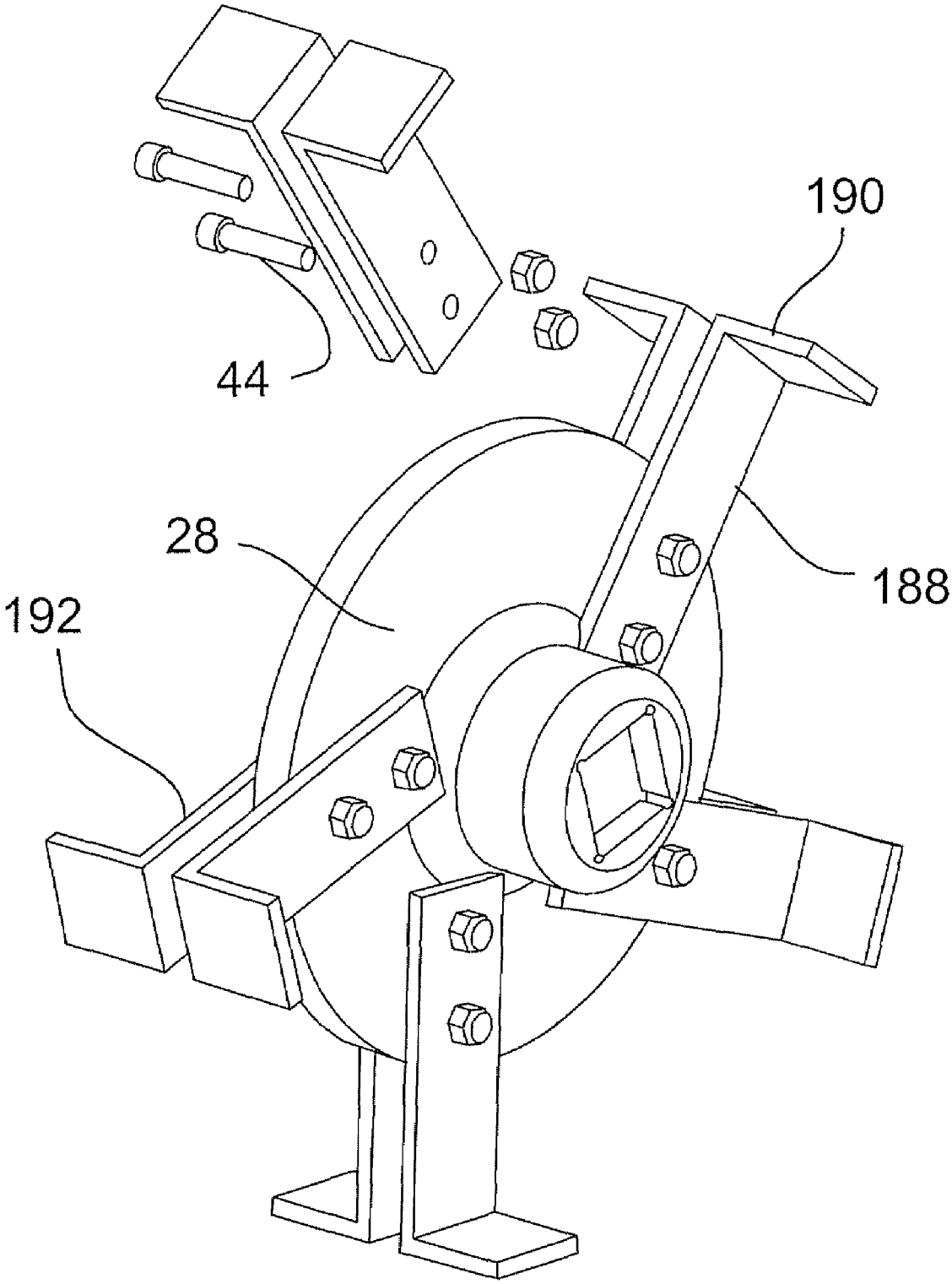
FIG. 3 is a side view of a disc with double-sided tines.

An embodiment of a disc 28 with double-sided tines is shown in FIG. 3. Each tine 188 comprises a leg 192 and a ground working base 190. Each tine 188 is secured to the disc 28 with bolts 44. Other means to attach each tine 188 to the disc 28 on which the respective tine is mounted are possible. Each tine 188 is paired with a second tine so that the ground working bases 190 of each tine lie on opposite sides of the plane defined by the disc 28. In the embodiment shown in FIG. 3, five paired tines 188 are secured to each disc 28; however, other numbers of tines 188 on each disc 28 may be possible. Also, the number of paired tines 188 on each disc 28 of a ground working device may differ from disc to disc. The discs 28 can be secured to a rod 30 (FIG. 5) with nuts 38 (FIG. 5), and interspaced along the rod 30 are bearings 40 (FIG. 5). The ground working base 190 of the tines 188 have a flow through and lifting surface that allows material to flow across and pass beyond the tine 188 without becoming balled up.

Figure 4:
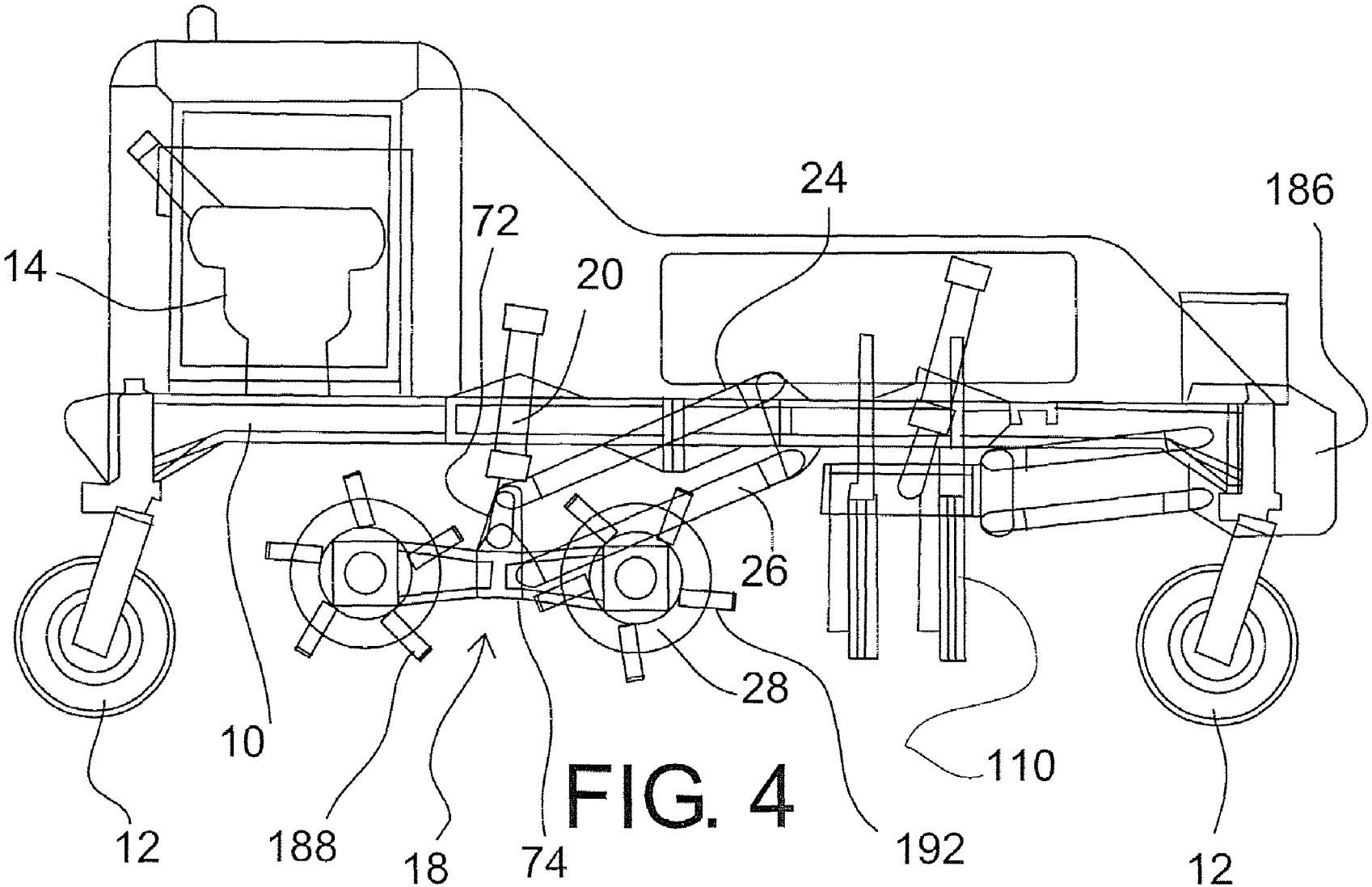
FIG. 4 is a side view of a ground working device in travel position with two sets of tines.

FIG. 4 shows a ground working device with a mobile main frame 10 being supported by ground engaging wheels 12. A continuous track would also be considered ground engaging wheels. The main frame 10 carries an engine assembly 14. A sub-frame 18 is retractably mounted under the frame 10 with hydraulic arms 20, and swing arms 24 and 26. The hydraulic arms 20, raise and lower the sub-frame 18 from a travel position to a maximum working position, and may fix the sub-frame at ground contacting positions between the travel position and maximum working position. The swing arms 24, 26 hold the sub-frame 18 in a level position in relation to the ground, with each set of discs 28 on the sub-frame at equal height. In an embodiment the engine assembly 14 includes a hydraulic assembly. An electrical control system (not shown) operatively connects to the engine assembly 14 for controlling the ground working device. The axis defined by the rod 30 extends transversely under the mobile main frame 18. Different engine assembly 14 and motor configurations may be used to rotate the plural discs 28. Lobes 72, which extend upward from the sub-frame 18 are connected to the hydraulic arms 20 and lobe 74 is connected to the swing arms 24, 26. The hydraulic arms 20 are hydraulically connected to the hydraulic assembly in the engine assembly 14. Tines 188 with a flow through and lifting surface are attached to the discs 28. The plural tines 188 are mounted on the discs for rotation opposed to the direction of movement of the mobile main frame 10 over the ground. However, the plural tines 188 may also be rotated in the reverse direction. In an embodiment, a ripper bar, such as retractable tooth assembly 110, extending transversely under the mobile main frame 10 is used to rip up the ground as the ground working device travels forward and before the tines 188 work on the ground.

FIG. 5 shows an embodiment of a ground working apparatus with particular applicability for liquid treated roads. A mobile main frame 10 is supported by ground engaging wheels 12. A sub-frame 18 is held by swing arms 24 and 26, although only swing arm 24 is shown in FIG. 5. Multiple discs 28 are connected to the sub-frame 18 by rods 30. The discs rotate about an axis extending transversely under the sub-frame 18 defined by the rods 30. Two sets of discs have tines 188 attached to each disc 28. The two sets of discs 28 may be offset from each other so that each set of discs 28 may work on different areas of the ground as the ground working device advances over the ground. The 188 tines have a ground working base 190 having a flow through and lifting surface. The ground working apparatus may have more or less than two sets of discs 28 having tines 188. In the embodiment shown in FIG. 5 a sub-set of the plural tines 188 are double-sided tines, which are also attached to the discs 28. An embodiment of a double-sided tine is shown in FIG. 3. Different proportions of double-sided tines to single-sided tines may be used depending on the working surface used with the ground working device. A set of plural tines 188 may include only single-sided tines or alternatively may include only double-sided tines. For each set of plural discs 28 a hydraulic motor 196 is attached to the set of plural discs for rotating the disc 28 about the axis defined by the rod 30. Each hydraulic motor 196 is hydraulically connected to the hydraulic assembly of the engine assembly 14. The ground working apparatus may have a set of ripper bars, for example a retractable tooth assembly 110, at the front to rip up ground as the ground working apparatus advances over the ground.

Figure 6:
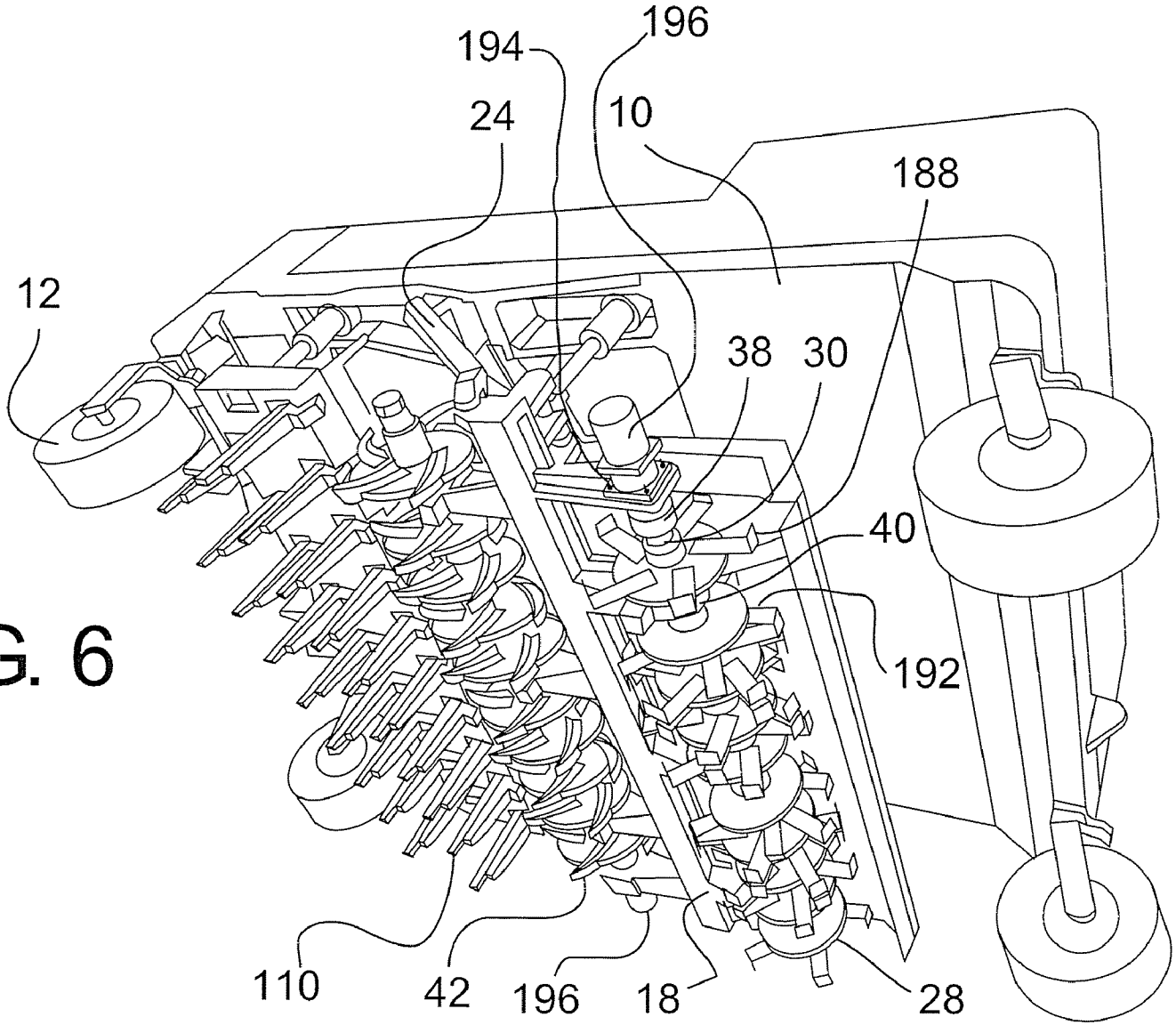
FIG. 6 is a perspective view of a ground working device with a set of scoops forward of a set of tines.
Figure 8:
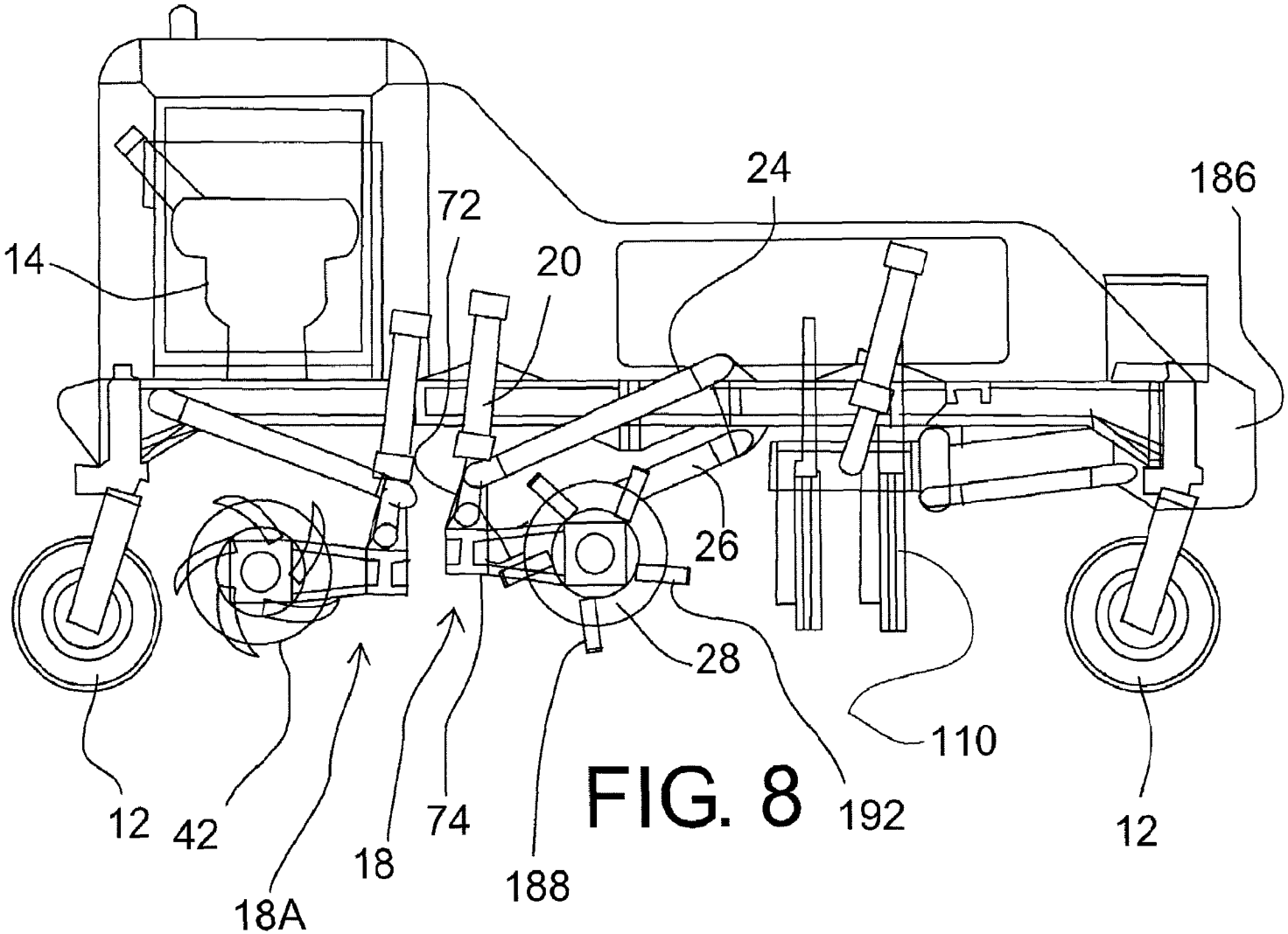
FIG. 8 is a side view of a ground working device in travel position with a set of tines and a set of scoops attached to separate sub-frames.

FIG. 6 shows an embodiment of a ground working apparatus with particular application to liquid treated roads. A mobile main frame 10 is supported by ground engaging wheels 12. A sub-frame 18 is held by swing arms 24 and 26, although only swing arm 24 is shown in FIG. 6. Multiple discs 28 are connected to the sub-frame 18 by rods 30. The discs 28 rotate about an axis defined by the rods 30. For each set of plural discs a hydraulic motor 196 is operatively attached to the set of plural discs for rotating the discs 28 about the axis defined by the rod 30. A set of discs 28 have tines 188 attached to each disc 28 and a set of discs 28 have scoops 42 attached to each disc 28. The scoops 42 are shown mounted on the same sub-frame as the discs 28, but may be mounted on a separate sub-frame 18A as is shown in FIG. 8. In the embodiment of FIG. 6 the hydraulic motor 196 attached to the set of discs having tines 188 and the hydraulic motor 196 attached to the set of discs having scoops 42 lie on the opposite ends of the sub-frame relative to each other. The tines 188 have a ground working base 190 having a flow through and lifting surface. In the embodiment of FIG. 6, the set of discs 28 having scoops 42 lies in front of the set of discs 28 having tines 188 as the ground working apparatus advances over the ground. The two sets of discs 28 may be offset from each other so that each set of discs 28 may work on different areas of the ground as the ground working device advances over the ground. The ground working apparatus may have more than one set of discs 28 having tines 188 and more than one set of discs having scoops 42. The sets of scoops and sets of tines can be placed in various different configurations in relation to each other as the ground working apparatus advances over the ground. The ground working apparatus may have a set of ripper bars, for example a retractable tooth assembly 110, located forward of both the set of discs 28 having tines 188 and the set of discs 28 having scoops 42 to rip up ground as the ground working apparatus advances over the ground.

In an embodiment, the sets of discs 28 having tines 188 and the sets of discs 28 having scoops 42 may be mounted for rotation on the sub-frame about an axis that extends transversely under the frame 10. The discs 28 can be secured to a rod 30 with nuts 38, and the rod can be connected to the sub-frame 18 at one end by easily removable bolts 194. In an embodiment four easily removable bolts 194 on one end of the rod 30 and two sets of easily removable bolts for each bearing 40 connect the rod 30 to the sub-frame 18. In the embodiments of FIGS. 5 and 6 three bearings 40 are attached to each rod by two bolts each. In FIGS. 5 and 6 only one of the three bearings 40 is visible. In total, for each rod 30 ten easily removable bolts connect the rod 30 to the sub-frame 18. The four easily removable bolts 194 connect the rod 30 to the sub-frame 18 on the same end of the rod 30 as the hydraulic motor 196. The removable bolts may allow the sets of discs having scoops and sets of discs having tines to be easily replaced or interchanged.

Figure 7:
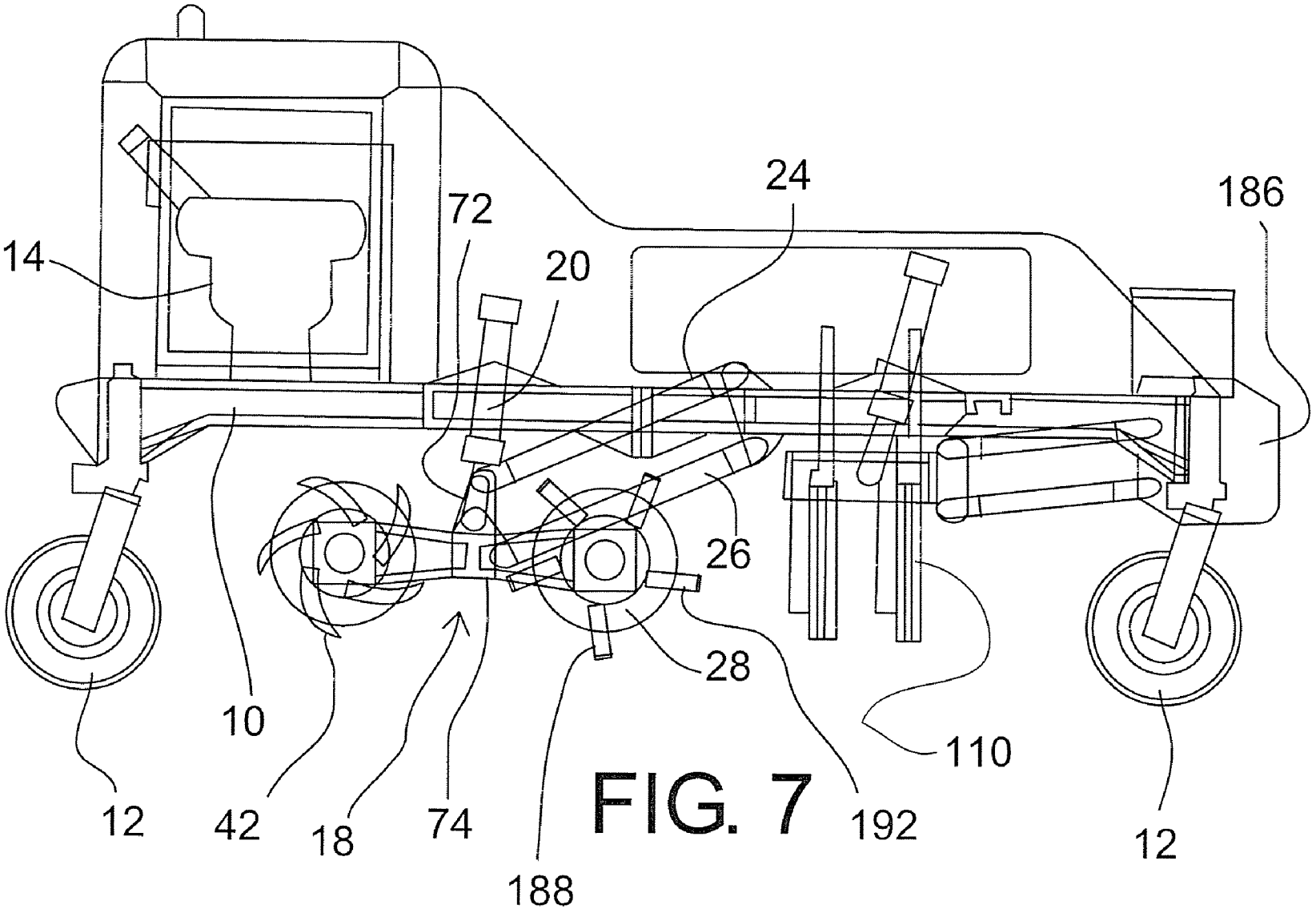
FIG. 7 is a side view of a ground working device in travel position with a set of tines forward of a set of scoops.

FIG. 7 shows an embodiment of a ground working apparatus particularly suited for application to liquid treated roads. A main frame 10 is supported by ground engaging wheels 12. A sub-frame 18 is held by swing arms 24 and 26. Multiple discs 28 are connected to the sub-frame 18 by rods 30. The discs 28 rotate about an axis defined by the rods 30. A set of discs 28 have tines 188 attached to each disc 28 and set of discs 28 have scoops 42 attached to each disc 28. The tines 188 have a ground working base 190 having a flow through and lifting surface. In the embodiment of FIG. 7, the set of discs 28 having tines 188 lies in front of the set of discs 28 having scoops 42 as the ground working apparatus advances over the ground. The ground working apparatus may have a set of ripper bars, for example a retractable tooth assembly 110, located forward of both the set of discs 28 having tines 188 and the set of discs 28 having scoops 42 to rip up ground as the ground working apparatus advances over the ground.

Figure 9:
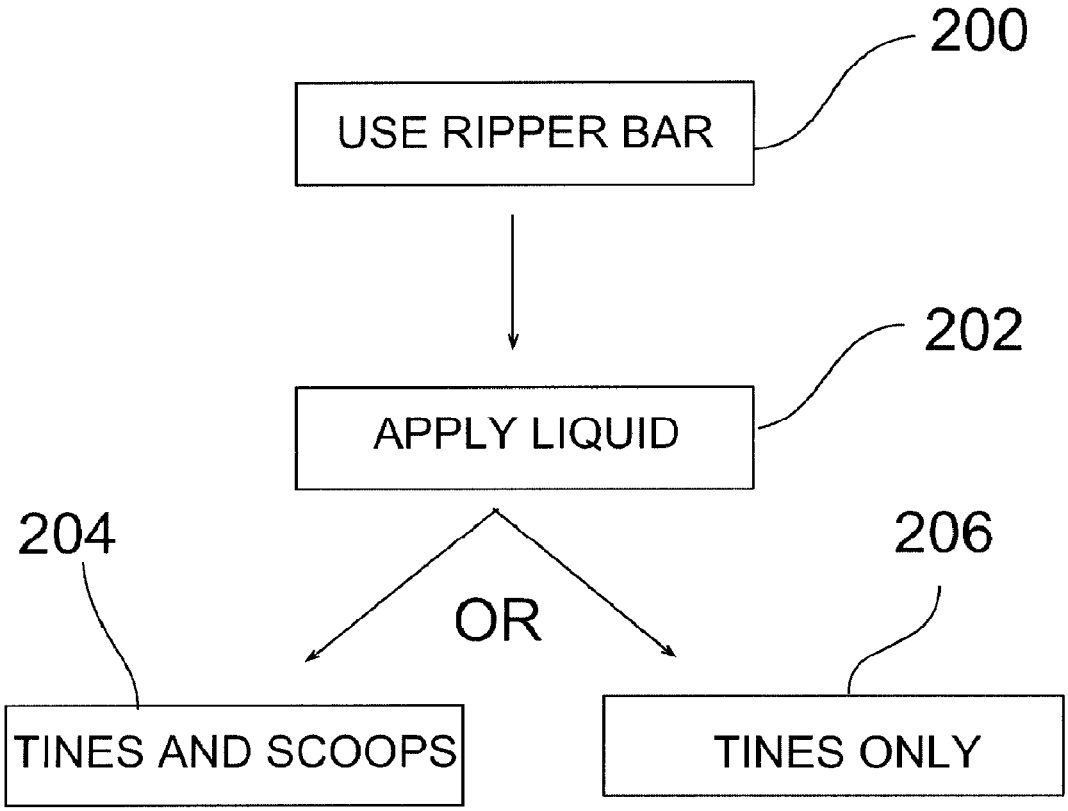
FIG. 9 is a flow diagram showing the method of producing a fully restored road.

In operation a ground working apparatus is drawn over a liquid treated road such as an oiled road or any other liquid treated road. The frame 10 may be attached by any suitable means such as by plates 186 to a vehicle, such as a grader or tractor, that tows the apparatus across a road surface. A set of ripper bars attached to the frame of the ground working apparatus may be used to rip up the ground as the ground working apparatus advances over the ground. The tines 188 and scoops 28 mounted on discs 28 then mix up the oil-ground mixture after the ripper bars have ripped up the surface. The ground working apparatus may be used for gravel roads or other suitable road surfaces, particularly liquid treated roads. The tines 188 and scoops may be constructed from an economically viable hard material so that they do not wear down too quickly. As shown in FIG. 9, a number of passes may be required to produce a fully restored road. The passes may include treatment with individual parts of the apparatus alone or in combination. Thus, one pass might break up the road only with the ripper bar as shown in step 200. Another pass might apply a liquid to a road as shown in step 202. Another pass might use tines, with or without scoops, to further break up, and cause mixing of the material making up the road surface as shown in steps 204 and 206. The tines granulate and mix the road surface as they rotate and contact the road surface.

What is claimed is:

1. A ground working apparatus for use on roads, the ground working apparatus comprising:

a mobile main frame;

a sub-frame retractably mounted under the mobile main frame;

plural discs mounted for rotation on the sub-frame about a tine rotation axis that extends transversely under the mobile main frame;

a set of tines mounted on each disc, each tine having a flow through and lifting surface; and a ripper bar extending transversely under the mobile main frame wherein each tine has a ground working base that extends axially in relation to the tine rotation axis away from the disc on which the respective tine is mounted and each tine comprises a leg secured to a corresponding disc, with the leg being bent at an angle of less than 15 degrees to a radius of the disc on which the respective tine is mounted.

2. The ground working apparatus of claim 1 further comprising a motor operatively connected to the plural discs for rotating each disc about the axis.

3. The ground working apparatus of claim 2 in which the mobile main frame is provided with ground engaging wheels.

4. The ground working apparatus of claim 1 further comprising a set of scoops having concave ground contacting surfaces mounted on each disc of a set of discs mounted for rotation about a scoop rotation axis that extends transversely under the mobile main frame.

5. The ground working apparatus of claim 4 in which the set of tines is mounted between the set of scoops and the ripper bar.

6. The ground working apparatus of claim 4 in which the set of scoops is mounted between the set of tines and the ripper bar.

7. A ground working apparatus for use on roads, the ground working apparatus comprising:

one or more sub-frames retractably mounted under a mobile main frame;

plural tines with a flow through and lifting surface mounted for rotation on the one or more sub-frames to dig into and lift ground material as the mobile main frame advances over the ground; and plural scoops with concave ground contacting surfaces mounted for rotation on the one or more sub-frames to dig into and lift ground material as the mobile main frame advances over the ground.

8. The ground working apparatus of claim 7 in which the plural tines and plural scoops are each mounted for rotation opposed to the direction of movement of the mobile main frame over the ground.

9. The ground working apparatus of claim 7 in which the tines and scoops are mounted on discs, the discs being mounted on rods extending transversely under the mobile main frame.

10. The ground working apparatus of claim 9 further comprising one or more motors operatively connected to the plural discs for rotating the discs about the axes defined by the rods.

11. The ground working apparatus of claim 10 in which each tine has a ground working base that extends perpendicularly to a plane defined by the disc on which the respective tine is mounted.

12. The ground working apparatus of claim 11 in which each tine comprises a leg secured to a corresponding disc, with the leg being at a non-zero angle to a radius of the disc on which the respective tine is mounted.

13. The ground working apparatus of claim 8 in which a retractable ripper bar is located on the mobile main frame forward of the sub-frame.

14. The ground working apparatus of claim 13 in which the plural tines are located forward of the plural scoops.

15. The ground working apparatus of claim 13 in which the plural scoops are located forward of the plural tines.

16. The ground working apparatus of claim 7 in which the plural tines comprise at least a subset of double-sided tines.

* * * * *

UNITED STATES PATENT AND TRADEMARK OFFICE

CERTIFICATE OF CORRECTION

PATENT NO. : 7,500,803 B2
APPLICATION NO. : 11/670929
DATED : March 10, 2009
INVENTOR(S) : R. W. Gillard et al.

It is certified that error appears in the above-identified patent and that said Letters Patent is hereby corrected as shown below:

Title Page

| COLUMN | LINE | ERROR |
|---|---|---|
| (30) | Foreign Appl. | insert in appropriate order: |
| Pg. 1, col. 1 | Priority Data | --(30) Foreign Application Priority Data Dec. 22, 2006 (CA) 2572443-- |

Signed and Sealed this

Twenty-fifth Day of August, 2009

David J. Kappos

David J. Kappos
*Director of the United States Patent and Trademark Office*